United States Patent [19]

Blackwell

[11] 4,093,886

[45] June 6, 1978

[54] AEROSOL DETECTION DEVICE

[75] Inventor: Lyman L. Blackwell, Boulder, Colo.

[73] Assignee: Statitrol Corporation, Lakewood, Colo.

[21] Appl. No.: 702,909

[22] Filed: Jul. 6, 1976

[51] Int. Cl.[2] ..... H01J 7/40

[52] U.S. Cl. ..... 313/54; 250/381

[58] Field of Search ..... 313/54; 250/381, 382, 250/384, 385, 388, 389; 324/33; 340/237 S

[56] References Cited

U.S. PATENT DOCUMENTS 4,012,729 3/1977 Weaver et al. ..... 313/54 X

*Primary Examiner*—James B. Mullins
*Assistant Examiner*—Darwin R. Hostetter
*Attorney, Agent, or Firm*—Max L. Wymore

[57] ABSTRACT

Fire alarm system utilizing an aerosol detector of the type formed by outer and inner interconnected ion chambers with a single particle source located within the inner chamber. The particle source radiates charged particles emitted therefrom into the inner chamber as well as through the path of chamber interconnection into the outer ion chamber. The outer chamber communicates directly with atmosphere to be monitored and operates as a sensing ion chamber. The inner chamber, operates as a reference ion chamber, is only interconnected with the outer chamber, and is otherwise totally isolated from outside atmosphere to avoid contamination of the particle source therein. Two embodiments of aerosol detector are disclosed. The first has a radiation permeable, aerosol impermeable dielectric film, made of a material such as Mylar, Teflon or the like, mounted as a barrier across the path of chamber interconnections to permit charged particles emitted from the particle source to pass essentially uninfluenced therethrough while isolating the inner chamber from smoke and combustion aerosols to prevent contamination of the particle source. The dielectric film also provides a physical barrier which prevents a detached particle source from falling out of the inner chamber. The second embodiment is like the first with the addition of a second similar type dielectric film which covers over the particle source itself. The second film improves the operation characteristics of the device as well as providing an additional physical barrier to hold the particle source in place. A third embodiment provides for selective positioning of the radioactive source and a collector electrode in the outer chamber.

32 Claims, 12 Drawing Figures

AEROSOL DETECTION DEVICE

BACKGROUND OF THE INVENTION

The present invention relates to the detection of aerosols, such as smoke and combustion aerosols, and to an improved device for detecting such aerosols.

More particularly, the present invention relates to aerosol detection devices of the general type disclosed and illustrated in copending U.S. Pat. application Ser. No. 588,153, now U.S. Pat. No. 4,012,729 which application was filed on June 19, 1975, and is assigned to the assignee of this application.

Disclosed and illustrated in the aforementioned patent application is a device for detecting smoke and like aerosols in atmosphere being monitored characterized by being formed of outer and inner interconnecting ion chambers and having a single particle or ion source located within the inner ion chamber. The particle source is positioned to radiate charged particles emitted therefrom into the inner ion chamber as well as through the path of interconnection of the ion chambers into the outer ion chamber. Thereby, through this construction, two different regions of ionization are maintained through the use of a single particle source.

The outer ion chamber is arranged to communicate directly with the atmosphere being monitored so that smoke and combustion aerosols in the atmosphere enter therein and is designed to function as a sensing ion chamber, as described in the aforementioned patent application. The inner ion chamber, which is designed to function as a reference ion chamber, connects directly only with the outer ion chamber and otherwise is totally isolated from all outside atmosphere in order to avoid contamination of the particle source therein.

It is noted that the terms outer and inner are employed herein to signify, respectively, that the outer ion chamber connects or communicates directly with the atmosphere outside of the aerosol detection device which is being monitored while the inner ion chamber has no path of direct connection or communication with any atmosphere outside of that within the device itself.

A problem inherent in this type of aerosol detection device is, that due to the free and direct path of connection existing between the outer and inner ion chambers, smoke aerosols entering the outer ion chamber from atmosphere outside the device may penetrate the inner ion chamber through the path of ion chamber interconnection and thereby contaminate the particle source. Such contamination of the particle source is detrimental to the operation of the aerosol detection device and can cause unstable and unreliable performance. Another problem inherent with the construction of this device described above is that, should the radioactive particle source become detached from the position in which it is safely mounted within the inner ion chamber, it could fall out of the inner chamber and create a radiation hazard for people in the surrounding area.

Patents of general interest with regard to the state of the art were listed in aforementioned U.S. Pat. application Ser. No. 588,153. This list of patents is incorporated herein by reference. Additionally, the following U.S. patents, which further illustrate the state of the art, have been cited in the copending U.S. patent application: U.S. Pat. Nos. 2,436,084; 3,585,649; 2,981,840; and, 3,295,121.

Of these last listed patents, U.S. Pat. No. 2,981,840 to Nahmias is of interest for its showing of the use of an electrically conductive thin metal foil to form a window through which alpha particles can be radiated from one ion chamber into another. As will become apparent, however, the construction, operation and concept of the Nahmias device is totally distinct and different from the improved aerosol detection device according to the present invention described hereinafter.

SUMMARY OF THE INVENTION

It is, accordingly, an object of the present invention to provide an improved device for detecting aerosols, such as smoke and other combustion aerosols.

It is further an object of the present invention to provide an improved aerosol detection device of the general type disclosed and illustrated in copending U.S. patent application Ser. No. 588,153, filed June 19, 1975, which improved device obviates the disadvantages, problems and drawbacks of such devices aforementioned herein.

It is additionally an object of the present invention to provide aerosol detection device characterized by having improved performance characteristics, including reduced size with increased sensitivity.

It is still another object of the present invention to provide an improved fire or combustion alarm system characterized by utilizing an improved aerosol detection device of the type hereinabove set forth.

In accomplishing these and other objects, there is provided in accordance with the present invention a fire alarm system utilizing an improved ionization aerosol detector. The aerosol detector utilized is of the general type disclosed in copending U.S. Pat. Application Ser. No. 588,153, filed June 19, 1975. The applicable portions of this copending patent application relating to the general construction and operation of this type of aerosol detector are hereby incorporated herein by reference.

Three embodiments of improved aerosol detector according to the present invention are provided. The first embodiment has a radiation permeable, aerosol impermeable dielectric film positioned across the path of interconnection of the inner and outer ion chambers of the detector. The dielectric film is effectively transparent to the charged particles emitted from the particle source positioned in the inner ion chamber of the detector so as to not interfere with or influence passage of the charged particles emitted therefrom being radiated into the outer ion chamber through the path of ion chamber interconnection. At the same time the dielectric film defines an aerosol impermeable or impervious barrier which prevents smoke aerosols within the outer ion chamber from penetrating the inner ion chamber and contaminating the particle source therein. Additionally, the dielectric film provides a physical barrier sufficiently strong to prevent the radioactive particle source, should it become detached, from creating a personnel hazard by falling out of the safe inner ion chamber.

The second embodiment of improved aerosol detector provided is constructed like the first embodiment with the addition of a similar type of dielectric film mounted to form a dielectric layer which directly covers over the particle source. The presence of the second dielectric film over the particle source has been found to improve the aerosol detection device by making its output less sensitive to temperature variations and avoid the necessity of an inner insulating sleeve. Further, the presence of the second dielectric film has been found to increase the detection sensitivity of the device to smoke and combustion aerosols. Additionally, the second film also operates as a physical barrier to hold the particle source safely mounted in proper position within the inner ion chamber. Further, the second film may have an electrical conductive layer deposited on either or both sides thereof rendering the film suitable as an electrode of the ion chamber.

The third embodiment provides for selectively positioning the radioactive source within the inner chamber and further is provided with a collecting electrode in the outer chamber to increase ionization current therein.

Additional objects of the present invention reside in the construction of the exemplary embodiments of aerosol detection device hereinafter particularly described in the specification and shown in the several drawings.

DETAILED DESCRIPTION OF THE PREFERRED EMBODIMENT

Figure 1:
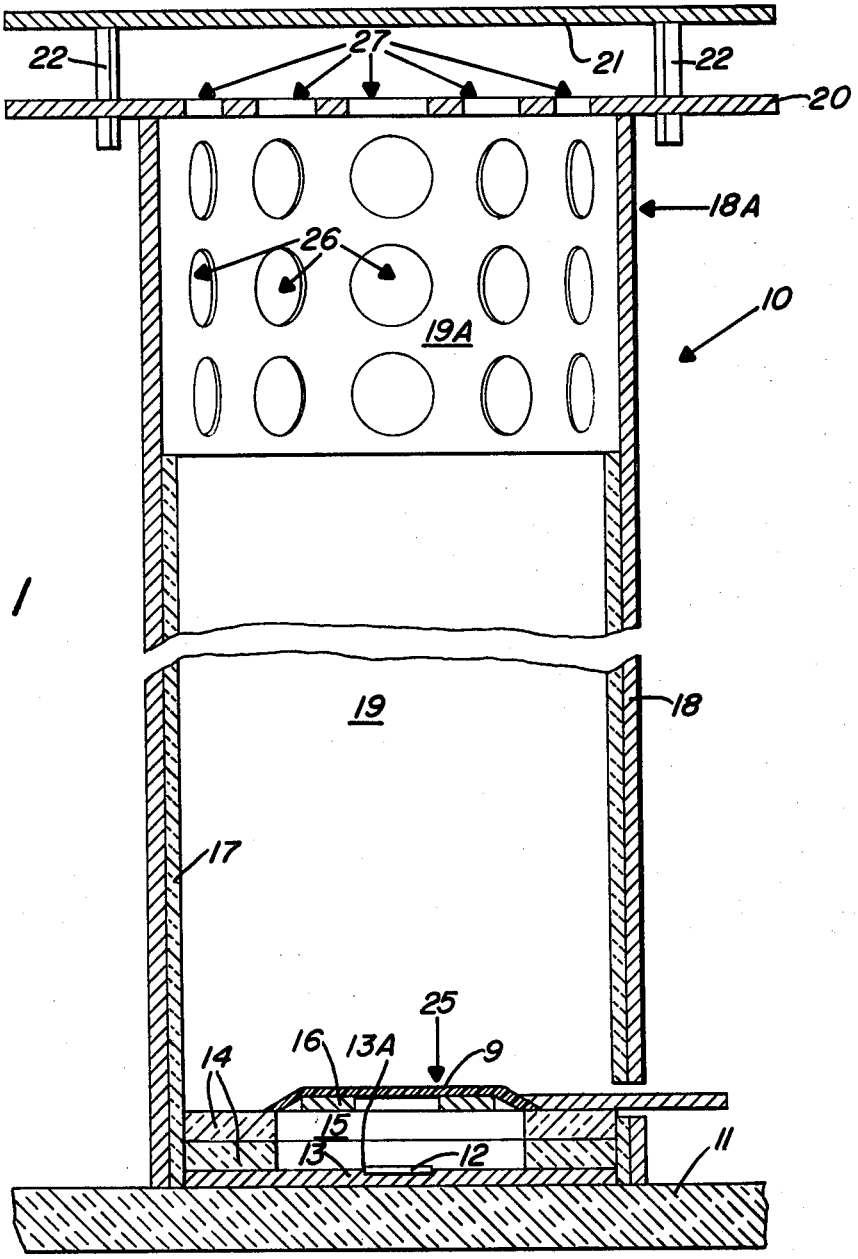
FIG. 1 is a cross sectional elevation view of an aerosol detection device according to the present invention.

Referring to the drawings in more detail, there is shown in FIG. 1 an ionization type aerosol or smoke detector generally identified by the numeral 10. The detector 10 is constructed like the detector shown and described in aforementioned U.S. Pat. application Ser. No. 588,153, filed June 19, 1975, with the exception that the detector 10 here described includes an additional component, i.e., a dielectric film 9.

The detector 10 is made up of the following components: a circuit board 11 made of an electrical insulating material; an ion source 12, which is preferably an alpha particle source; an electrically conductive element 13 which functions both as a holder for the particle source 12 and as an electrode; insulating washers or rings 14 which define a first ionization region and inner ion chamber 15; an electrically conductive element or planar ring 16 which functions as an electrode; the dielectric film 9 which defines a radiation permeable, aerosol impermeable barrier across the open end of the inner ion chamber 15; an inner cylindrical sleeve 17 made of an electrical insulating material; a cylinder 18 made of an electrically conductive material, the cylinder 18 being positioned around the sleeve 17 and defining in conjunction with the sleeve 17 a second ionization region and outer ion chamber 19; an electrically interconnected electrostatic shields 20, 21 mounted in a parallel, spaced apart and aligned disposition by support structure 22. The structure 22 may be formed as tab portions on the shield 21 bent to form the interconnecting brace structure.

As shown in FIG. 1, the cylindrical electrode 18 is mounted on the planar circuit board 11 to extend perpendicularly therefrom. The insulating sleeve 17, which is a selected distance shorter in length than the electrode 18, is positioned within the electrode 18 with one end in contact with the circuit board 11. Positioned on the circuit board 11, within the sleeve 17, is the electrode 13. The electrode 13 is in the shape of a disc and preferably has a slight depression 13A formed centrally therein for receiving the particle source 12. The particle source 12 is shown mounted in the depression 13A in a substantially parallel disposition with respect to the plane of the electrode 13.

The insulating rings 14 fit with the sleeve 17 and are positioned on the electrode 13 to define around the particle source 12 the inner ionization chamber 15. The inner chamber 15 is cylindrical in shape and has its axis concentric with that of the electrode 18, the sleeve 17 and the axis of radiation of the ion source 12.

The ring electrode 16 is positioned against the outwardly positioned insulating washer 14 in a substantially parallel disposition with respect to the electrode 13. The electrode 16 further is disposed centrally within the sleeve 17 with its center axis concentric with the center axis of the cylindrical electrode 18. The ring electrode 16 defines an aperture 25 through which particles emitted by the particle source 12 are introduced into the ionization region 19.

The dielectric film 9 is mounted or secured on the outer side of the outwardly positioned insulating washer 14 to define a barrier across the path of interconnection between the inner and outer ion chambers 15 and 19. As mentioned above, the dielectric film 9 is radiation permeable, but gas impermeable. As used herein, the term radiation permeable means that the barrier defined by the dielectric film 9 appears essentially transparent to the charged particles emitted from the particle source 12, i.e., the alpha particles emitted by the source 12 pass easily therethrough into the outer ion chamber 19. The term aerosol impermeable as used herein means that the dielectric material 9 is impermeable to, and defines a barrier which prevents the passage of, smoke, combustion aerosols and like aerosols which can contaminate the inner chamber and particle source 12.

It is noted the dielectric film 9 is preferably made of a ¼ to ½ mil thick layer of Mylar or Teflon. Any suitable dielectric material having the above-mentioned radiation permeable, aerosol impermeable characteristics, however, may be employed. Further, it is noted that the dielectric film 9 is preferably electrically non-conductive and hence does not disturb the electrical operation of the device 10 and its ring electrode 16.

The portion 18A of the cylindrical electrode 18 extending beyond the insulating sleeve 17 has smoke entry holes 26 formed therein. Further, the electrostatic shield 20 positioned across the end of the cylindrical electrode 18 has smoke entry holes 27 formed therein. The electrode portion 18A in conjunction with the shield 20 defines a perforated cup which functions to permit the entry of smoke in the surrounding atmosphere into the detector 10.

The shields 20, 21 illustrated are in the form of cylindrical discs and are positioned substantially perpendicular to the center axis of the detector 10. The center axis of the detector 10 is defined by the longitudinal axis of the cylindrical electrode 18. The outer shield 21 has no smoke entry holes formed therein and the shields 20, 21 together function to prevent static charges in the surrounding atmosphere from disrupting ion currents in the detector 10.

Figure 2:
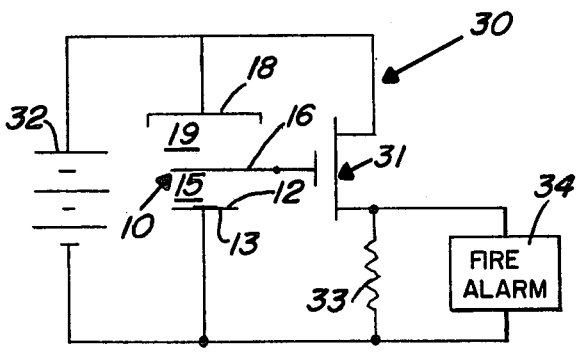
FIG. 2 is a circuit diagram of a fire alarm system having the detector of FIG. 1 incorporated therein.

The smoke detector 10 is shown in FIG. 2 incorporated in a fire alarm system generally identified by the numeral 30. The system 30, in addition to the detector 10, includes a field effect transistor (FET) 31, a DC voltage source 32, a load resistor 33 and a fire alarm 34.

The voltage source 32 may, for example, supply 10 volts DC, and will be assumed to be a 10 volt DC source in the discussion hereinafter. As shown in FIG. 2, the negative terminal of the voltage source 32 is connected to the detector electrode 13, while its positive terminal is connected to the detector electrode 18. The detector ring electrode 16 is connected to the gate electrode of the FET 31. The drain-source current path of the FET 31 is connected in series with the load resistor 33 across the voltage source 32, with one terminal of the resistor 33 being connected in common with the negative terminal of the voltage source 32. The fire alarm device 34 is connected across and in parallel with the load resistor 33 to be actuated by the voltage signal generated thereon.

An exemplary smoke detector 10 constructed in accordance with the present invention was made with essentially the same dimensions as that described in assignee's aforementioned copending patent application. The detector 10 constructed had a length along its center axis of approximately 34.3 millimeters, a radius of about 12.5 millimeters, and the portion 18A of the electrode 18 defined a cylindrical sensing volume 19A of approximately 15 millimeters in length.

Reference is here made to copending U.S. Patent application Serial No. 588,153, filed June 19, 1975, and particularly drawing FIGS. 4, 5, 5A, 5B, 6A, 6B, 7 and 8 thereof. The plots shown therein of equipotential lines, elecctric field, voltage, voltage gradient and ion density as well as the Bragg curve there illustrated are applicable to the exemplary detector 10 here described. Therefore, the information contained in these drawing figures as well as the portions of the application specification relating thereto are hereby incorporated herein by reference. In summary, these plots indicate that the average voltage gradient and ion density in the inner ion chamber 15 of the detector are substantially higher than that of its outer chamber 19. It is this relatively high field and ion density in the region 15 which has been found to render the impedance or resistance of same substantially constant so that the inner ion chamber 15 is suitable for use as a reference ion chamber. Thus, in the detection of smoke aerosols and the like by the device 10, the inner ion chamber 15 functions as an essentially constant current source reference between the detector electrodes 13 and 16.

It is noted that the nonlinear voltage gradient established in the detector 10 discussed above, i.e., high voltage gradient through the inner chamber 15 followed by a relatively low voltage gradient in the outer chamber 19, is due to the geometry and shape of the detector 10 and its components, and the location and shape of its electrodes.

In operation of the detector 10 and the fire alarm system 30 shown in FIG. 2, the ionization region 15 operates as a constant current source, the magnitude of which is substantially uninfluenced by smoke aerosols; while the region 19 operates as a variable resistance connected between electrodes 16 and 18, the magnitude of which increases due to the presence of smoke aerosols therein and in the sensing volume 19A.

Figure 7:
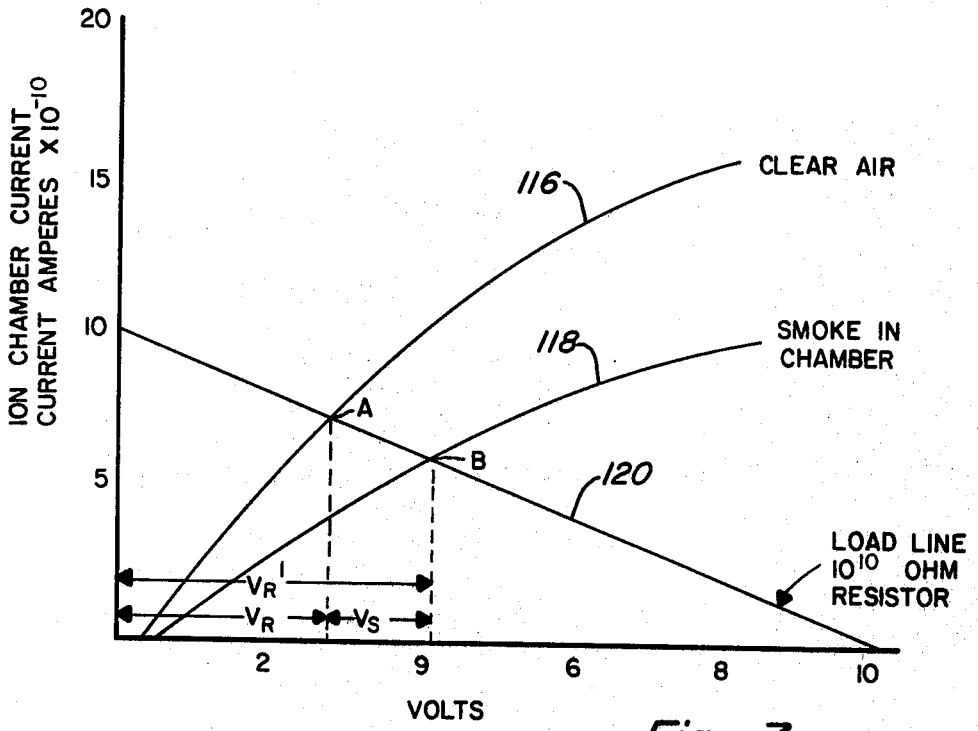
FIG. 7 is a graphical representation of the detection operation of FIG. 8.
Figure 8:
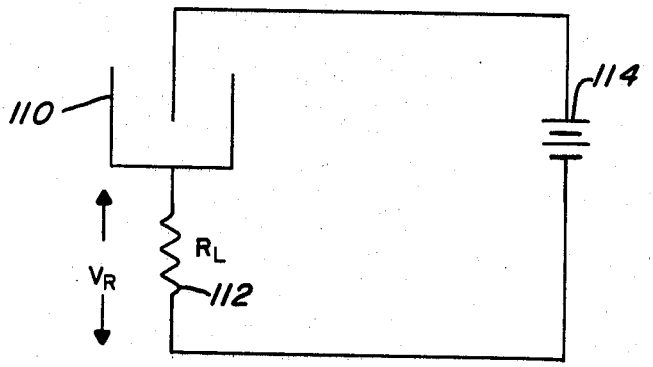
FIG. 8 is a schematic of the equivalent circuitry of a single ion chamber detector as a part of the known art.

To illustrate this more vividly, reference is made to FIG. 7 of the drawing which represents a plot of the voltage-current characteristics of a single ionization chamber 110 circuit, schematically represented in FIG. 8, operating in series with a load 112 consisting of a $10^{10}$ ohm resistor and battery 114. Curve 116 is a plot of the response of the ion chamber 110 in clear air and curve 118 is a plot of the response of the ion chamber with smoke in the chamber. The slope of the load line 120 which represents a plot of $R = I/E$ is determined by the value of the resistor $R_L$ in the following equation:

(1) $E = 10$ volts where:

$R_L = 10^{10}$ ohms $E = 10$ volts

I will equal $10^{-10}$ amps and the intersection of the load line 120 at point A is the chamber operating point in clear air and point B is the chamber operating point with smoke in the chamber. Voltage $V_R$ represents the voltage across resistor $R_L$ and voltage $V_R'$ is the voltage across the resistor $R_L$ with smoke in the chamber. Voltage Vs is the chamber signal voltage developed due to the entry of smoke into the chamber.

Figure 9:
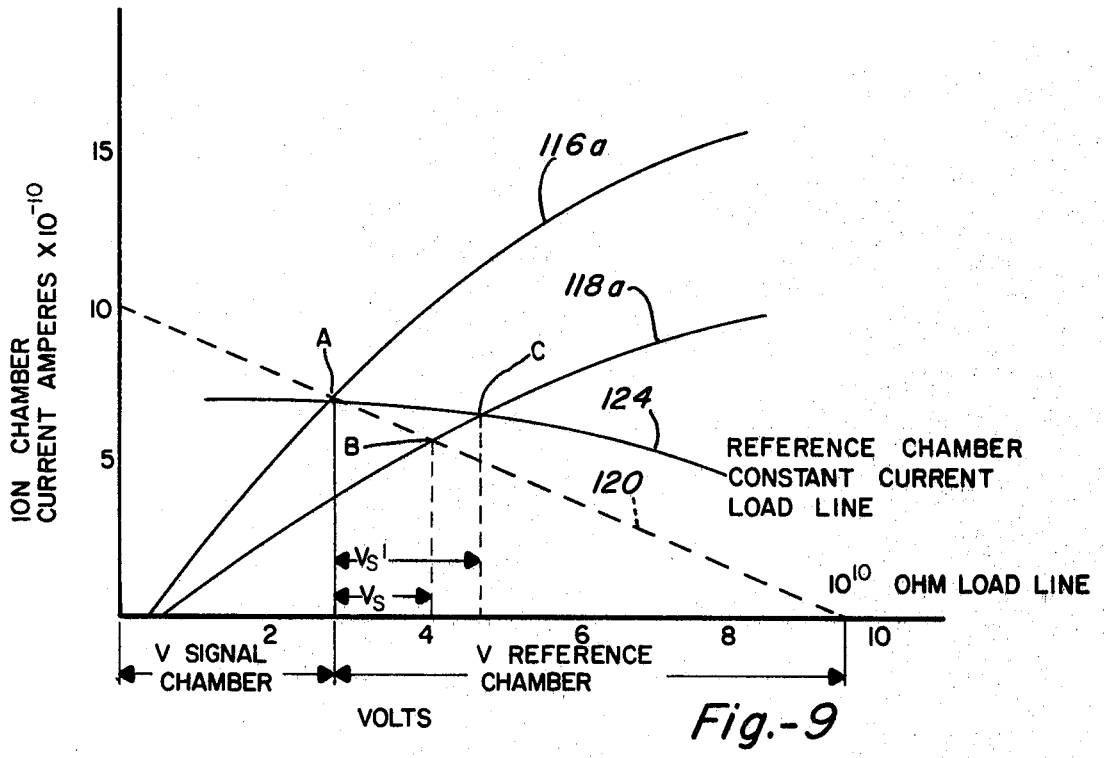
FIG. 9 is a graphical representation of the detection operation of two ion chambers in series as depicted in FIG. 10.
Figure 10:
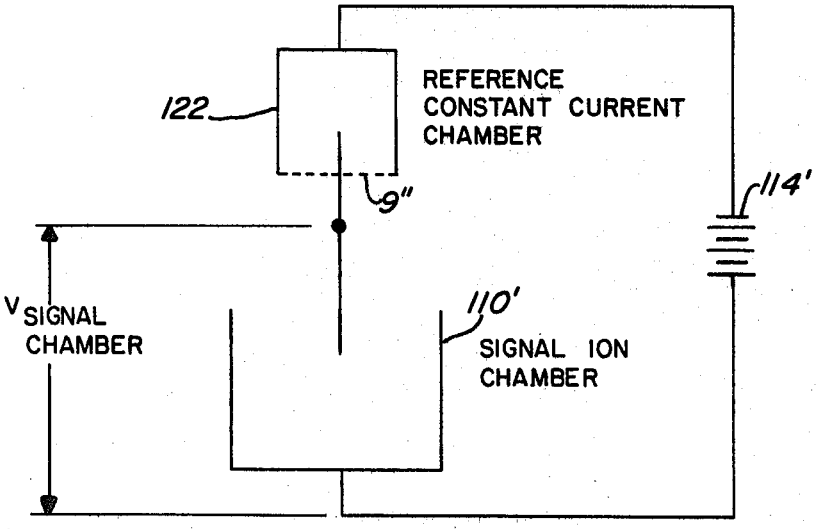
FIG. 10 is a schematic of the equivalent circuitry of a dual ion chamber arrangement connected in series.

FIG. 9 of the drawing represents a plot of the voltage-current characteristics of two ion chambers connected in series. The reference ion chamber 122, FIG. 10, is provided with a smoke impervious membrane 9'' of Teflon or Mylar and the like and replaces the resistor $R_L$ of FIG. 8. The reference chamber 122 is designed to saturate and provides the constant current curve 124. The curve 124 replaces the load line 120 of FIG. 7 which is shown dotted in FIG. 9 for comparison. Curve 124 now establishes the operating points of the ion chamber 110'. Point A' is the operating point of the series chambers 122 and 110' in clear air and point C is the operating point of the series chambers in smoke. Point B is superimposed on FIG. 9 for illustration. Vs' is the signal level due to the presence of smoke in the chamber and the difference between Vs and Vs' represents the increase in sensitivity of the series chambers over a single chamber using a load resistor.

Figure 3:
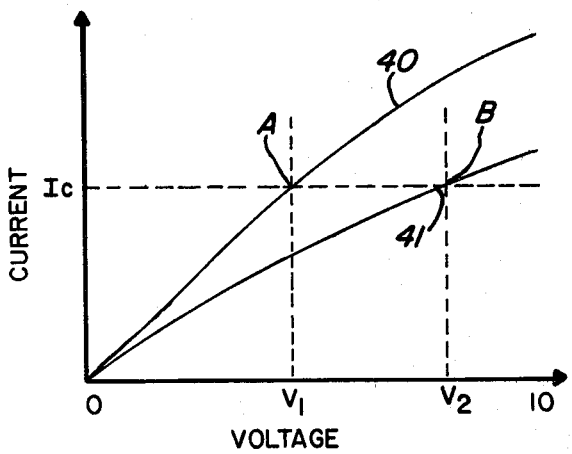
FIG. 3 is a voltage current plot relating the ion current of the detector of FIG. 1 to its electrode voltages.

Referring to FIG. 3, curve 40 is a plot under clear air conditions of ion current through the electrically in series ionization regions or chambers 15, 19 as a function of the DC voltage applied across the electrodes 13 and 18. With ten volts DC applied, the constant ion current in the detector 10 is $I_c$. Thus, under clear air conditions with ten volts DC applied across the electrodes 13 and 18, the voltage $V_1$ at $I_c$, point A, is present on the ring electrode 16.

Curve 41 is a plot of ion current $I_c$ through the detector 10 upon entry of smoke into the sensing region of the detector 10. As shown in FIG. 3, the constant ion current $I_c$ on curve 40 moves to point B upon the entry of smoke into the detector 10. This change in operating point causes the voltage on the ring electrode 16 to change to $V_2$.

Referring to FIG. 2, the voltage drop on the electrode 16 caused by the entry of smoke into the detector 10, i.e., $V_1 - V_2$, appears on the gate electrode of the FET 31. As a consequence, the drain-source current of the FET 31 changes and causes the generation of a voltage signal on the load resistor 33 to actuate the conventional fire alarm device 34. Actuation of the alarm 34 thus indicates the entry of smoke aerosols into the detector 10.

During operation of the detector 10, the dielectric barrier 9 functions to prevent smoke and other aerosols within the outer sensing chamber 19 from penetrating the inner ion chamber 15. Thus, the inner ion chamber 15 is isolated from aerosols in the atmosphere surrounding the detector 10 and in the atmosphere being monitored thereby. Thus, contamination of the particle source 12 mounted within the inner chamber 15 by such aerosols is prevented. Thereby, unstable and unreliable operation of the detector 10 caused by such contamination of the particle source 12 is avoided. Further, the dielectric barrier 9 defines a physical barrier of sufficient strength to hold the radioactive particle source 12 within the inner chamber 15 should it become detached from the position in which it is mounted in the recess 13A of the electrode 13. Thereby, danger of the particle source 12 falling out of the safe inner chamber 15 and creating a radiation hazard for personnel in the surrounding area is reduced.

It is noted that the circuitry of the fire alarm system 30 is preferably incorporated in the printed circuit board 11 of the detector 10. Further, the FET 31 acts as a voltage amplifier in the system 30, being connected as a source follower.

It is also noted that in the construction of the detector 10, the presence of the insulating sleeve 17 functions to limit the collection of emitted ions by the electrode 18 to the sensing region 19A defined by the cylindrical electrode portion 18A. This sensing volume 19A is located a selected distance from the particle source 12 to enhance ion collection, thereby to render this sensing region more sensitive to smoke. The dimensions of the detector 10 indicated earlier herein are particularly suited for use with an alpha particle source since the average range of emitted alpha particles which are introduced into region 19 is approximately 30 millimeters. Further air currents within the sensing volume 19A tend to cause the ions to be collected by the electrode portion 18A, rather than being blown away. This minimizes problems due to air velocity and winds.

Presence of smoke entry holes only in the shield 20 give best air velocity results for the smoke detector 10 since the shield 21 then operates inherently to shield the sensing volume 19A from air current and winds. The holes 26 in the electrode portion 18A, however, increase sensitivity of the detector 10 to smoke aerosols. The sizes of the holes 26, 27 are such to permit easy penetration of smoke aerosols.

It is remarked that operation of the detector 10 is relatively uninfluenced by changes in atmospheric conditions, such as temperature, pressure and humidity changes which alter the range of emitted alpha particles, since the length and location of the sensing volume 19A defined by the electrode portion 18A may be arranged to maximize ion collection under all atmospheric conditions expected to be encountered.

It is additionally remarked that the size of the aperture 25 and of the outer diameter of the ring electrode 16 may be varied to establish ion density between the regions 15 and 19. Increasing the size of the aperture 25, for example, has the effect of increasing the number of ions entering the region 19, and thus of increasing the ion current and average density therein. A change in the size of the aperture 25 and the outer diameter of the ring electrode 16 also changes the angles at which alpha particles are emitted by the source 12 into the region 19. Inherently, the average range of the emitted alpha particles in region 19 is a function of these angles.

It is also noted that one of the reasons for the relatively high ion density in the region 15 is that the alpha particles emitted by the source 12 have relatively low energy, less than 2 million electron volts (MEV), and thus, are stopped in this region. This tends to maximize ion current in the region 15 which may increase its insensitivity to smoke aerosols. Thus, the outer and inner diameter of the collecting ring 16 may be varied to alter the temperature, pressure and humidity characteristics of the smoke detector.

The insulating sleeve 17 employed in the detector 10 may be made of a Teflon material, since such has been found to have sufficient volume and surface resistivity under high humidity conditions. A Teflon material may also be used for the insulating rings 14 used to define the reference ion chamber or region 15. A suitable particle source is a planar shaped nuclear foil containing the radioactive element Americium, which is an alpha particle source. The nuclear foil is typically made of a layer of Americium and gold, covered over on the alpha emitting side with gold layers and on the non-emitting side with at least one layer of silver. The Nuclear Radiation Development Company, 2937 Alt Boulevard North, Grand Island, New York, produces a nuclear foil suitable for use as the ion source 12, which it identifies as its Model AMM. Alpha particle emission in approximately the 5.4 MEV range constitutes typically 99.6 percent of the radiation of such sources, while gamma radiation constitutes the balance. Virtually no beta radiation is emitted by these sources.

Figure 4:
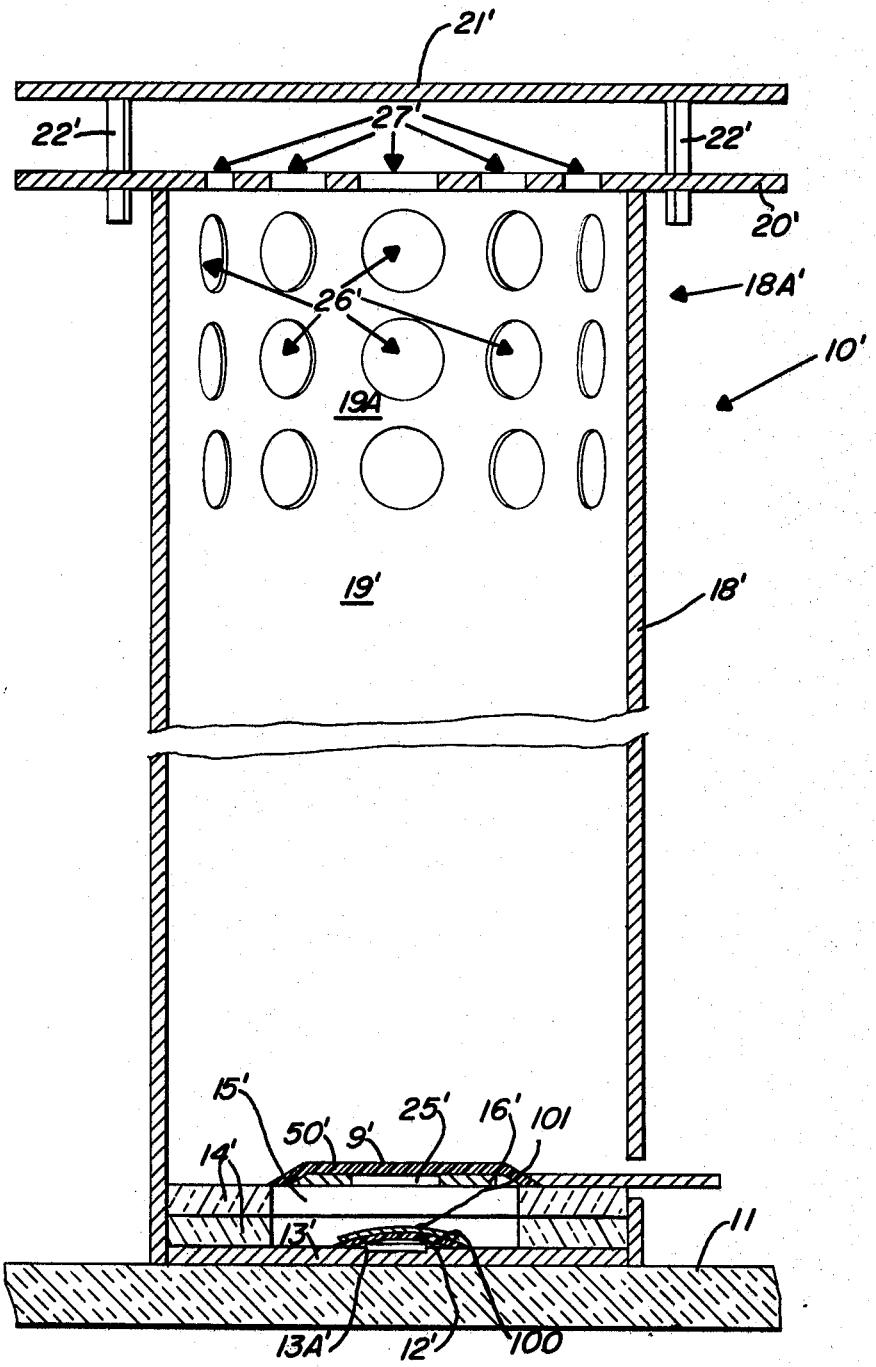
FIG. 4 is a cross sectional elevation view of another embodiment of aerosol detection device according to the present invention.

Referring to FIG. 4, another embodiment of smoke or aerosol detector is there shown identified by the numeral 10'. Except for the differences hereinafter noted, the construction and operation of the detector 10' corresponds to that of the detector 10 described hereinbefore. Therefore, components of the detector 10' are identified by the same numerals employed to identify corresponding components in the detector 10, with a prime added. It will be noted that insulation sleeve 17 is omitted where the dielectric film 100 is provided to cover the source 12 for reasons to be explained.

As shown in FIG. 4, the detector 10' has a dielectric film or layer 100 mounted or secured on the electrode 13 to cover over the particle source 12'. The dielectric film 100 is similar to the film forming the dielectric barrier 9', being radiation permeable, aerosol impermeable and preferably formed of a layer of Teflon or Mylar film ¼to ½mil thick.

In operation of the detector 10', when connected in a circuit like that shown in FIG. 2, the presence of the dielectric film 100 covering the source 12' has been found to improve the performance of the detector 10' by making its output voltage characteristic less sensitive to ambient temperature variations. This fact is illustrated by the graphs of FIG. 5 wherein curves 101 and 102, respectively, are plots of the output voltage of the detectors 10 and 10' as a function of ambient temperature, all other conditions being maintained substantially constant.

Figure 5:
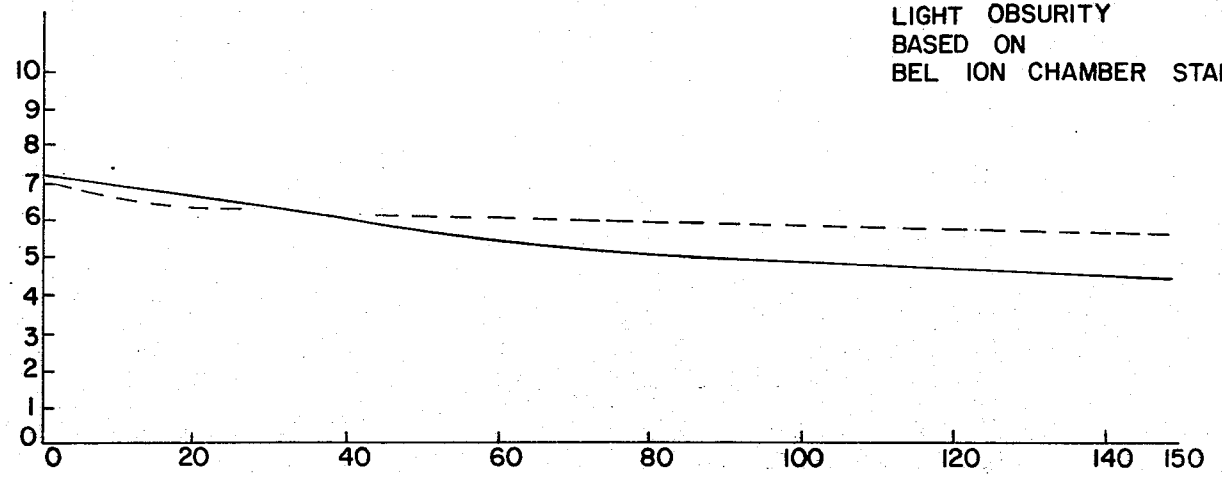
FIG. 5 is a graphical representation of the output voltage characteristic of each of the detectors of FIGS. 1 and 4 as a function of ambient temperature illustrated side by side for purposes of comparison.

As shown in FIG. 5, the output voltage of the detector 10 (output voltage characteristic shown as the solid line curve 101) drops substantially, i.e., almost three volts, as a result of an increase in temperature from 0° to 150° F. The output voltage of the detector 10' (output voltage characteristic shown as the dashed line curve 102) remains, however, relatively constant for the same change in ambient temperature. Thus, it is apparent that the detector 10' is less sensitive to temperature variations than the detector 10.

Figure 12:
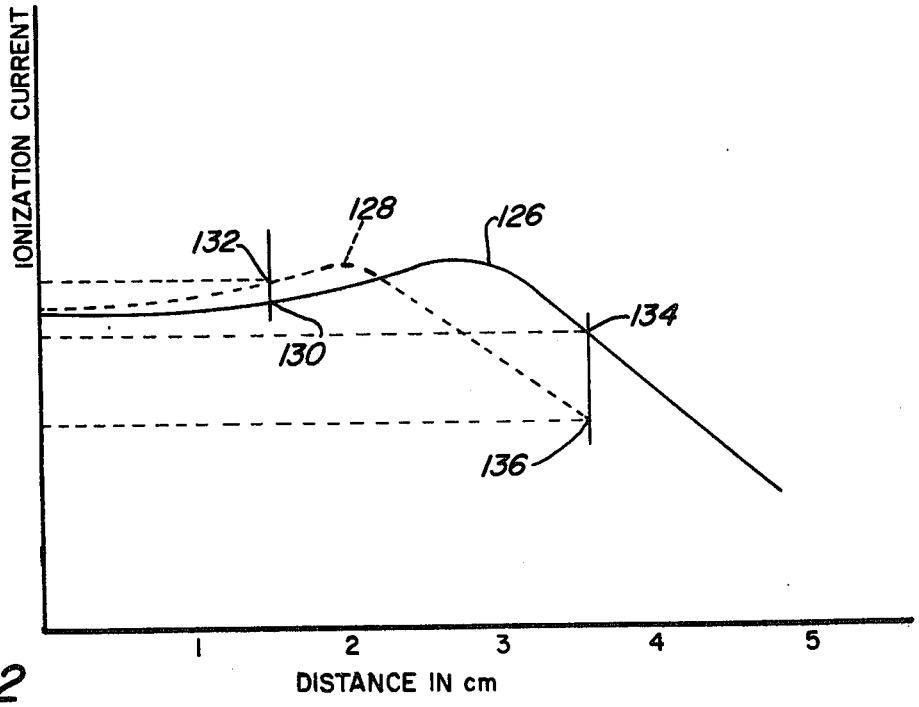

It is also important to note that the film covering the radioactive source causes the peak of the Bragg curve to occur closer to the source and thus eliminates the need of an insulating sleeve 17 as in FIG. 1 to insure that the particles travel a sufficient distance to maximize collisions. Referring now to FIG. 12, in air an alpha particle will traverse a finite distance of several centimeters before it is absorbed by collision between the air molecule and the alpha particle. This collision process produces large numbers of ions which are then collected by the voltage gradient applied across the chamber to produce an ion current. FIG. 12 represents a graph of this specific ion current plotted against the range of a single energy alpha particle in air identified as curve 126. This curve 126 is the well-known Bragg curve. If the same source 12 producing the alpha particle radiation is covered with a thin ($\frac{1}{4}$ to $\frac{1}{2}$ mill) film 100 of Teflon or Mylar, the resulting Bragg curve will be shortened as shown by curve 128, shown dotted.

In the operation of an ionization chamber for detecting smoke particles, the covering of the radioactive source 12, with a Teflon or Mylar film, as indicated, moves the clear air operating point of the ion chamber from point 130 on curve 126 to point 132 on curve 128, point 132 being closer to the peak of the Bragg curve. Smoke particles entering the chamber increases the density of the air in the chamber and absorbs a sufficiently larger quantity of alpha particles to move the smoke operating point 134 of the chamber further into the negative slope of the Bragg curve. In the negative slope region the specific ionization level and resulting ion current decrease very rapidly with increase in smoke density. This results in an increase in the sensitivity of the ionization chamber to smoke by the use of the film 100 immediately over the source 12. The increase in sensitivity is represented in FIG. 12 by the differential between points 132 and 136 as compared to the differential between points 130 and 134. This increase may amount to an increase in sensitivity to smoke by as much as 35% over the sensitivity of an ion chamber without a film covering the radioactive source. The use of a film of radiation pervious, aerosol impervious material over the radiation source of the usual single ion chamber arrangement will provide an increase in the sensitivity thereof over what will normally be expected due to the shift in the Bragg curve. This will permit the use of a smaller volume in the ion chamber to provide the same degree of sensitivity. This fact is illustrated by FIG. 6.

Figure 6:
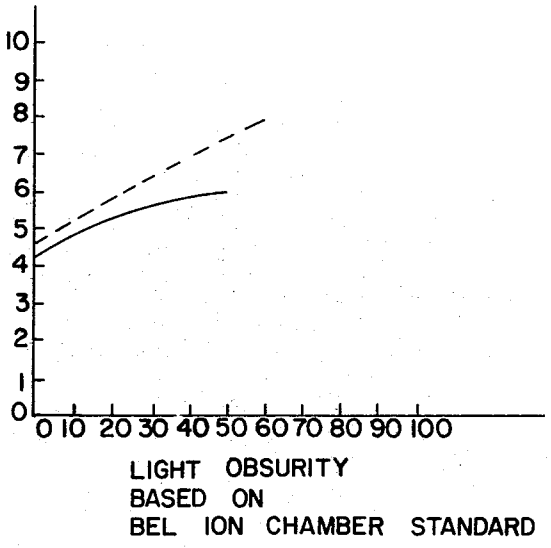
FIG. 6 is a graphical representation of the detection sensitivity of each of the detectors of FIGS. 1 and 4 illustrated side by side for purposes of comparison.

FIG. 6 shows change in detector output voltage in response to smoke and combustion products formed as a result of burning a cotton fuse in the atmosphere being monitored by the detectors 10 and 10'. The solid line curve 103 represents the increase in output voltage of the detector 10 while the dashed line curve 104 represents output voltage increase for the detector 10'. As apparent from FIG. 6, the output voltage of the detector 10' increases at a more rapid rate than that of the detector 10 in response to the combustion aerosols created by the burning cotton fuse. Thus, the detection sensitivity characteristic of the detector 10' is superior to that of the detector 10.

It is noted that in conducting the tests illustrated by the graphs of FIGS. 5 and 6 that the detectors 10 and 10' employed had the dimensions of the exemplary detector hereinbefore described. Further, in the detectors used for these tests, a $\frac{1}{2}$ mil Teflon film was employed in the detector 10 as the dielectric barrier 9 while $\frac{1}{4}$ mil Teflon films were utilized in the detector 10' for both the barrier 9' and the covering film 100.

It is also noted that the presence of the covering dielectric film 100 in the detector 10' has the added advantage of providing an additional physical barrier for holding the particle source 12' safely within the inner ion chamber 15', the film 100 functioning to hold the source 12' in proper position on the electrode 13'. The film 100 may have an electrical conductive layer 101 attached or secured thereto in a suitable manner on either or both sides which may function or serve as the or another electrode for sensing ion current flow in the ion chamber. A suitable electrical connection to layer 101 may be brought outside the chamber for electrical connection to the sensing circuit.

Figure 11:
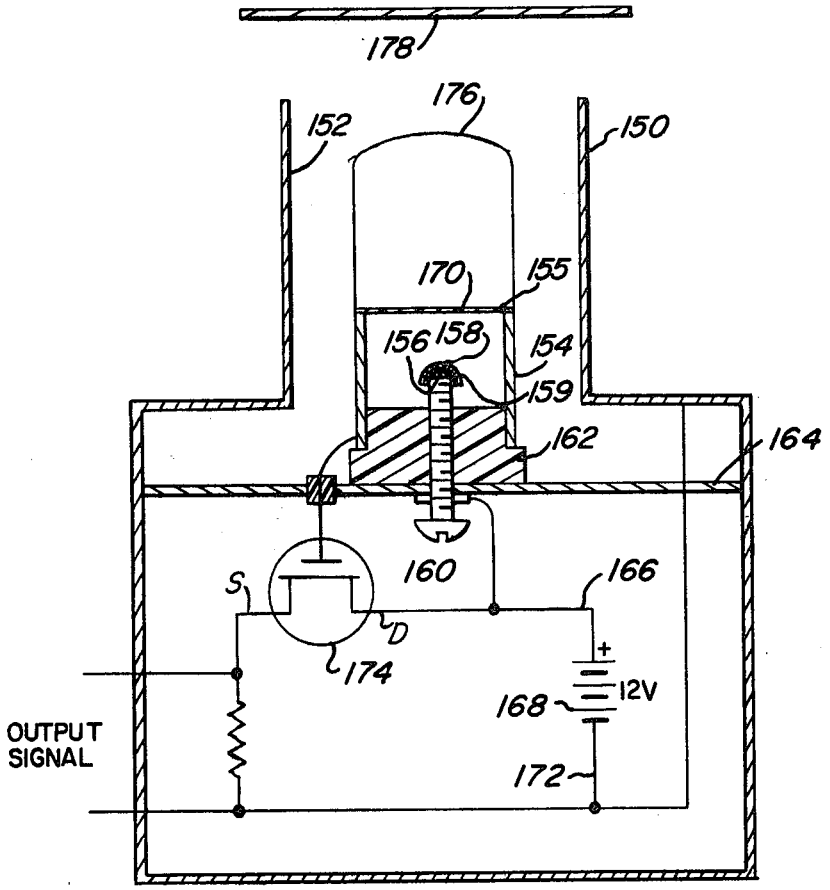
FIG. 11 is a cross sectional elevational view of another embodiment of aerosol detection device according to the invention; and, FIG. 12 is a graphical representation depicting the Bragg curves of two ion chamber arrangements, one of which has the radioactive source covered with an aerosol impermeable membrane.

Referring now to FIG. 11, there is shown another embodiment of a dual concentric ion chamber arrangement according to the present invention. This embodiment comprises a dual ionization chamber 150 having two ionization chambers 152 and 154 connected across a source of DC power. The arrangement is such that the inner chamber 154 is positioned inside the outer chamber 152 to form a concentric arrangement. The inner chamber 154 is provided with a radioactive source 156 mounted upon a bolt or center electrode 160 threadably secured in a support 162 of insulation material to permit selective vertical positioning of the source 156. The support 162 is mounted on a base 164 which conveniently may be a printed circuit board containing the depicted circuitry. The inside chamber 154 may conveniently be a length of metal tubing and the open end thereof is covered with a thin film 170 ($\frac{1}{8}$ to $\frac{1}{2}$ mill) of Teflon, Mylar or other non-conductive aerosol impervious, radiation pervious film. The walls of chamber 154 are conductive and the bolt 160 is also a conductor and is connected to one terminal 166 of a power source 168. The bolt or center electrode 160 is insulated from the wall 155 of chamber 154 by means of support 162 which may conveniently be constructed of Teflon. The radiation source 156 ionizes the air contained within the inside chamber 154 producing a current flow between the center electrode 160 and the wall of chamber 154. The radiation (alpha and beta rays) from the source 156 also penetrates the film 170 covering the top of the inside chamber 154 and ionizes the air contained within the outside chamber 152. The outside chamber wall is connected to the other terminal 172 of power source 168. The ionizing of the air in the outer chamber 152 completes the current path from the wall of the outer chamber 152 to the power source 168.

The outside chamber is open to the surrounding air and any aerosols such as products of combustion entering the outer chamber will produce a decrease in the amount of ionization in the outside chamber and cause an increase in the amount of voltage drop between the walls of the two concentric chambers 152 and 154. This voltage increase is detected by an appropriated high impedance device such as a MOSFET field effect transistor 172. An output signal is developed across a resistor 173 connected between the source of the transistor 174 and terminal 172 of the power source.

The inside chamber ionization is not effected by the products of combustion due to the film 170 acting to block entry of aerosols into the inner chamber 154. As previously stated, the covering of the source 156 with a thin film 158 of Teflon or Mylar improves the temperature characteristics of the concentric chambers which protects the source from contamination and also increases the sensitivity of the ion chamber arrangement to the presence of products of combustion. Also the provision of a center collecting electrode 176 attached to the upper open end 155 of the inner chamber 154 preferably in the form of a wire loop increases the ion current within the outer chamber 152 and hence the sensitivity of the system 150. Again, an electrostatic shield 178 may be positioned opposing the opening to chamber 152. Similarily the film 158 may be provided with a layer 159 of electrically conducting material which may serve as a sensing electrode for the chamber.

Although the invention has been shown herein and described in what is conceived to be the most practical and preferred embodiments, it is recognized that departures may be made therefrom within the scope of the invention. Although an alpha particle source is taught as being preferred, the use of beta and gamma sources may be made with reasonable success.

What is claimed is:

1. An aerosol detection device, comprising:

means for defining inner and outer ion chambers;

means for defining a path of interconnection between said inner and outer ion chambers;

means for isolating said inner ion chamber except through said path of ion chamber interconnection from atmosphere outside thereof;

means for connecting said outer ion chamber in communication with atmosphere to be monitored;

particle source means positioned within said inner ion chamber for emitting and radiating charged particles into said inner ion chamber and through said path of ion chamber interconnection into said outer ion chamber;

a barrier of dielectric material formed across said path of ion chamber interconnection which is radiation permeable and aerosol impermeable, said dielectric barrier being permeable to and permitting the passage of said charged particles being radiated into said outer ion chamber, said dielectric barrier being impermeable to and preventing the passage of smoke aerosols and the like whereby to isolate the particle source of said device from contamination; and, electrode means for generating and sensing ion current flow through said ion chambers.

2. The invention defined in claim 1, wherein said dielectric barrier is a film of dielectric material.

3. The invention defined in claim 1, including a layer of radiation permeable, aerosol impermeable dielectric material formed to cover over said particle source means.

4. The detection device according to claim 1 wherein the detection device includes an ion collector means connected to opposing portions of the inner ion chamber and positioned within the outer ion chamber.

5. The invention defined in claim 3, wherein said dielectric layer formed over said particle source means is a dielectric film.

6. The invention defined in claim 3, wherein said dielectric barrier and dielectric layer are each formed by a film of dielectric material.

7. An aerosol detection device, comprising:

means for defining inner and outer ion chambers, each of said ion chambers having first and second ends;

means for defining a path of interconnection between the second end of said inner ion chamber and the first end of said outer ion chamber;

means for isolating said inner ion chamber except through said path of ion chamber interconnection from atmosphere outside thereof;

means for connecting the second end of said outer ion chamber in communication with atmosphere to be monitored;

a first electrode positioned adjacent the first end of said inner ion chamber;

a second electrode positioned within said path of ion chamber interconnection;

a third electrode positioned adjacent the second end of said outer ion chamber;

particle source means positioned within said inner ion chamber for emitting and radiating charged particles into said inner ion chamber and through said path of ion chamber interconnection into said outer ion chamber; and, a barrier of dielectric material formed across said path of ion chamber interconnection which is radiation permeable and aerosol impermeable, said dielectric barrier being permeable to and permitting the passage of said charged particles being radiated into said outer ion chamber, said dielectric barrier being impermeable to and preventing the passage of smoke aerosols and the like whereby to isolate said particles source means from contamination.

8. The invention defined in claim 7, wherein said dielectric barrier is a film of dielectric material.

9. The invention defined in claim 7, including a layer of radiation permeable, aerosol impermeable dielectric material formed to cover over said particle source means.

10. The invention defined in claim 9 wherein the second electrode comprises a conductive layer formed on said dielectric layer.

11. The invention defined in claim 9, wherein said dielectric barrier and dielectric layer are each formed by a film of dielectric material.

12. The detection device according to claim 7 wherein the detection device includes an ion collector means connected to opposing portions of the inner ion chamber and positioned within the outer ion chamber.

13. The invention defined in claim 7, wherein:

said inner and outer ion chambers are substantially cylindrical;

said inner and outer ion chambers each have a longitudinal axis and have their longitudinal axes substantially aligned;

the effective volume of said inner ion chamber is substantially smaller than the effective volume of said outer ion chamber; and, said particle source means is positioned centrally in said inner ion chamber adjacent to said first electrode.

14. The invention defined in claim 13, including a layer of radiation permeable, aerosol impermeable dielectric material formed to cover over said particle source means.

15. The invention defined in claim 14 wherein the second electrode comprises a conductive layer formed on said dielectric layer.

16. The invention defined in claim 14, wherein said dielectirc barrier and dielectric layer are each formed by a film of dielectric material.

17. The invention defined in claim 13, wherein:

said first electrode is in the shape of a disc and extends substantially perpendicularly to the aligned longitudinal axes of said ion chambers with its center axis aligned therewith;

said second electrode defines a planar ring having an aperture therein through which charged particles emitted by said particle source means may pass, said second electrode being positioned substantially parallel to said first electrode with the center axis of the ring defined thereby substantially aligned with the aligned longitudinal axes of said ion chambers; and, said third electrode defines a sensing volume in the form of a cylindrical cup and has its center axis substantially aligned with the aligned longitudinal axes of said ion chambers.

18. In an aerosol detection device wherein inner and outer ion chambers are interconnected by a path of interconnection and a single particle source is positioned in the inner ion chamber to emit and radiate charged particles into the inner ion chamber and through the path of ion chamber interconnection into the outer ion chamber, the improvement in combination therewith of:

means for isolating the inner ion chamber except through the path of ion chamber interconnection from atmosphere outside thereof;

means for connecting the outer ion chamber in communication with atmosphere to be monitored; and, a barrier of dielectric material formed across the path of ion chamber interconnection which is radiation permeable and aerosol impermeable, said dielectric barrier being permeable to and permitting the passage of the charged particles being radiated into the outer ion chamber, said dielectric barrier being impermeable to and preventing the passage of smoke aerosols and the like whereby to isolate the particle source of said device from contamination.

19. The invention defined in claim 18, wherein said dielectric barrier is a film of dielectric material.

20. The invention defined in claim 18, including a layer of radiation permeable, aerosol impermeable dielectric material formed to cover over the particle source.

21. The invention defined in claim 20 wherein the second electrode comprises a conductive layer formed on said dielectric layer.

22. The invention defined in claim 20, wherein said dielectric barrier and dielectric layer are each formed by a film of dielectric material.

23. The detection device according to claim 18 wherein the detection device includes an ion collector means connected to opposing portions of the inner ion chamber and positioned within the outer ion chamber.

24. An aerosol detection device, comprising:

means for defining inner and outer ion chambers;

means for defining a path of interconnection between said inner and outer ion chambers;

means for isolating said inner ion chamber except through said path of ion chamber interconnection from atmosphere outside thereof;

means for connecting said outer ion chamber in communication with atmosphere to be monitored;

particles source means positioned within said inner ion chamber for emitting and radiating charged particles into said inner ion chamber and through said path of ion chamber interconnection into said outer ion chamber, including a layer of radiation permeable, aerosol impermeable dielectric material formed to cover over said particle source means; and, electrode means for generating ion current flow through said ion chambers.

25. An aerosol detection device, comprising:

means for defining inner and outer ion chambers, each of said ion chambers having first and second ends;

means for defining a path of interconnection between the second end of said inner ion chamber and the first end of said outer ion chamber;

means for isolating said inner ion chamber except through said path of ion chamber interconnection from atmosphere outside thereof;

means for connecting the second end of said outer ion chamber in communication with atmosphere to be monitored;

a first electrode positioned at the first end of said inner ion chamber;

a second electrode positioned within said path of ion chamber interconnection;

a third electrode positioned at the second end of said outer ion chamber;

particle source means positioned within said inner ion chamber for emitting and radiating charged particles into said inner ion chamber and through said path of ion chamber interconnection into said outer ion chamber; and, wherein the particle source means includes a layer of radiation permeable, aerosol impermeable dielectric material formed to cover over said particle source means.

26. The invention defined in claim 25, wherein:

said inner and outer ion chambers are substantially cylindrical;

said inner and outer ion chambers each have a longitudinal axis and have their longitudinal axes substantially aligned;

the effective volume of said inner ion chamber is substantially smaller than the effective volume of said outer ion chamber; and, said particle source means is positioned centrally in said inner ion chamber adjacent to said first electrode including a layer of radiation permeable, aerosol impermeable dielectric material formed to cover over said particle source means.

27. In an aerosol detection device wherein inner and outer ion chambers are interconnected by a path of interconnection and a single particle source is positioned in the inner ion chamber to emit and radiate charged particles into the inner ion chamber and through the path of ion chamber interconnection into the outer ion chamber, the improvement in combination therewith of:

means for isolating the inner ion chamber except through the path of ion chamber interconnection from atmosphere outside thereof;

means for connecting the outer ion chamber in communication with atmosphere to be monitored; and, a layer of radiation permeable, aerosol impermeable dielectric material formed to cover over the particle source.

28. The invention defined in claim 27 wherein the second electrode comprises a conductive layer formed on said dielectric layer.

29. A particle source means for use in an aerosol detection device comprising a radiation source covered by a dielectric layer comprising a film of radiation permeable dielectric material.

30. The particle source means of claim 29 wherein the film is of a dielectric material selected from the group consisting of Mylar and Teflon.

31. The particle source means of claim 29 wherein the film is of Teflon.

32. The particle source means of claim 29 wherein the film is provided with an electrical conductive layer.

* * * * *